US006948646B2

(12) United States Patent
Huang

(10) Patent No.: US 6,948,646 B2
(45) Date of Patent: Sep. 27, 2005

(54) NAILER HAVING SAFETY SWITCH FUNCTION

(76) Inventor: Wen-Sheng Huang, 58, Ma Yuan West St., Taichung (TW)

( * ) Notice: Subject to any disclaimer, the term of this patent is extended or adjusted under 35 U.S.C. 154(b) by 79 days.

(21) Appl. No.: 10/743,681

(22) Filed: Dec. 19, 2003

(65) Prior Publication Data

US 2005/0145665 A1 Jul. 7, 2005

(51) Int. Cl.[7] ..... B25C 1/04
(52) U.S. Cl. ..... 227/8; 227/130
(58) Field of Search ..... 227/8, 142, 130

(56) References Cited

U.S. PATENT DOCUMENTS 5,551,621 A * 9/1996 Vallee ..... 227/8
5,791,545 A * 8/1998 Lin ..... 227/8
5,836,501 A * 11/1998 Lai ..... 227/8
6,116,488 A * 9/2000 Lee ..... 227/8
6,213,372 B1 * 4/2001 Chen ..... 227/8
6,422,446 B1 * 7/2002 Liu ..... 227/8
6,588,642 B1 * 7/2003 Wang et al. ..... 227/8
6,659,324 B1 * 12/2003 Liu ..... 227/8
6,662,989 B1 * 12/2003 Chang et al. ..... 227/8
6,866,177 B1 * 3/2005 Chen ..... 227/142

* cited by examiner

*Primary Examiner*—Scott A. Smith
(74) *Attorney, Agent, or Firm*—Alan D. Kamrath; Nikolai & Mersereau, P.A.

(57) ABSTRACT

A nailer includes a gun body, a safety lever, a push device, and a contact trigger device. The push device includes an urging member, and a torsion spring, and the contact trigger device includes a mounting member, an O-ring, an elongated contact member, and an elastic member. The torsion spring has an elastic force smaller than that of the elastic member. Thus, the nailer is operated only when the first end of the safety lever is initially pressed on a workpiece and the trigger is then pressed, thereby providing a safety function to the user.

3 Claims, 5 Drawing Sheets

NAILER HAVING SAFETY SWITCH FUNCTION

BACKGROUND OF THE INVENTION

1. Field of the Invention

The present invention relates to a nailer having a safety switch function, and more particularly to a nailer having a safety switch function.

2. Description of the Related Art

A conventional nailer having a safety switch in accordance with the prior art is disclosed in the Taiwanese Patent No. 120810. However, the conventional nailer having a safety switch has a complicated construction, thereby increasing costs of fabrication and thereby causing inconvenience to the user when assembling the nailer.

SUMMARY OF THE INVENTION

The primary objective of the present invention is to provide a nailer having a safety switch function.

Another objective of the present invention is to provide a nailer, wherein the nailer is operated only when the first end of the safety lever is initially pressed on a workpiece and the trigger is then pressed, thereby providing a safety function to the user.

A further objective of the present invention is to provide a nailer, wherein when the first end of the safety lever is not pressed on a workpiece, the ejection switch of the nailer will not be operated, thereby providing a safety function to the user to prevent the user from operating the nailer due to touching the trigger unintentionally, so as to protect the user's safety.

A further objective of the present invention is to provide a nailer, wherein the nailer has a simplified construction, thereby decreasing costs of fabrication and thereby facilitating the user mounting the nailer.

In accordance with the present invention, there is provided a nailer, comprising a gun body, a safety lever, a push device, and a contact trigger device, wherein:

- the gun body is provided with a trigger having an inside formed with a receiving space for mounting the push device;
- the push device is pivotally mounted on the trigger and includes an urging member, and a torsion spring;
- the urging member is pivotally mounted on the trigger;
- the torsion spring is mounted on the urging member and has a first end rested on an end of the urging member and a second end rested on the trigger, the torsion spring has an elastic force smaller than that of an elastic member mounted in the contact trigger device;
- the safety lever is movably mounted on the gun body and has a first end protruded outward from the gun body and a second end formed with a catch portion that is movable to touch the urging member;
- the first end of the safety lever is pressed on a workpiece, so that the catch portion of the safety lever is moved into the trigger to touch the urging member; and
- the trigger is pressed toward the gun body to drive the urging member to touch the contact trigger device, thereby triggering the contact trigger device.

Further benefits and advantages of the present invention will become apparent after a careful reading of the detailed description with appropriate reference to the accompanying drawings.

DETAILED DESCRIPTION OF THE INVENTION

Figure 1:
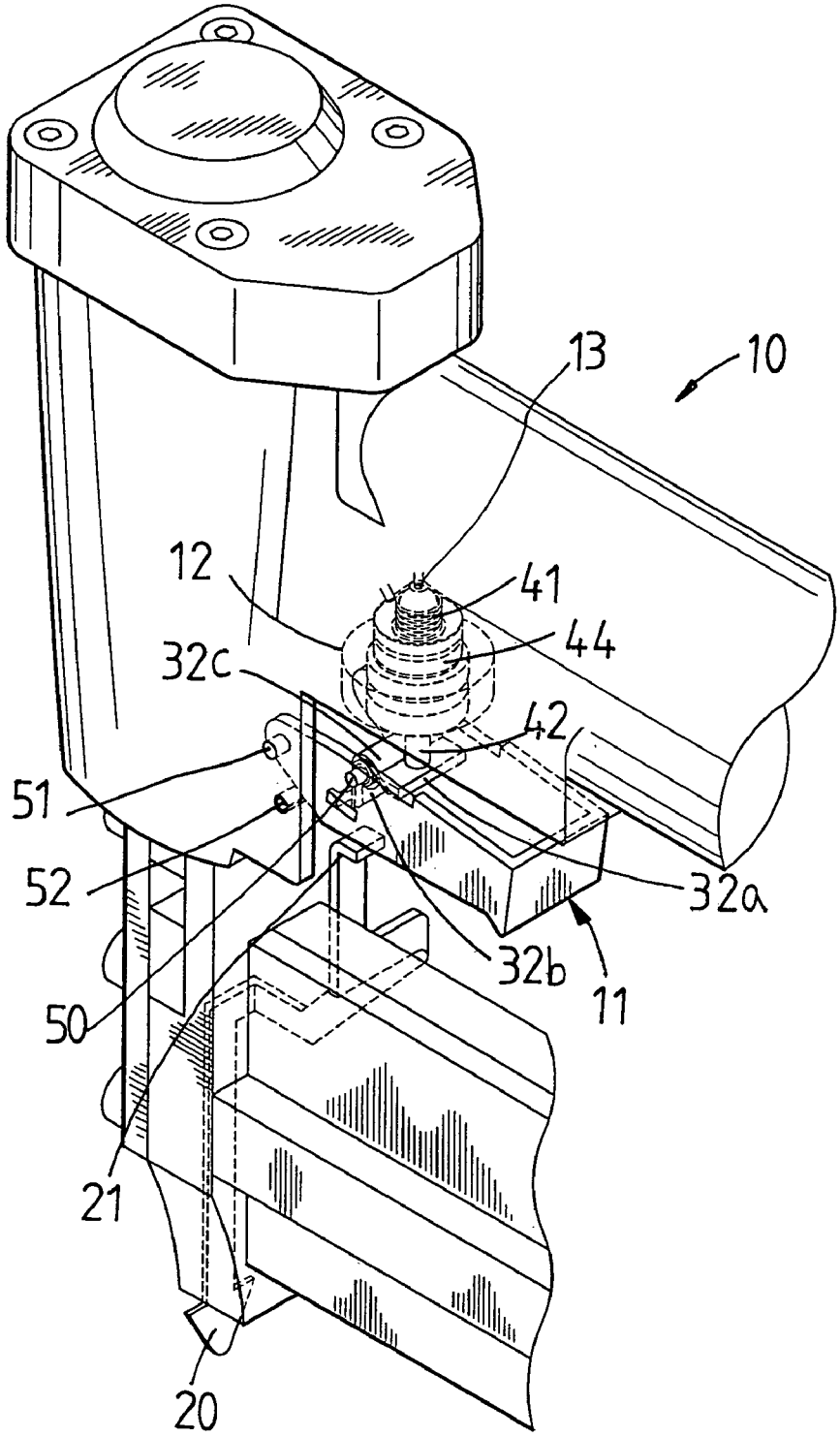
FIG. 1 is a partially cut-away perspective view of a nailer in accordance with the preferred embodiment of the present invention.
Figure 2:
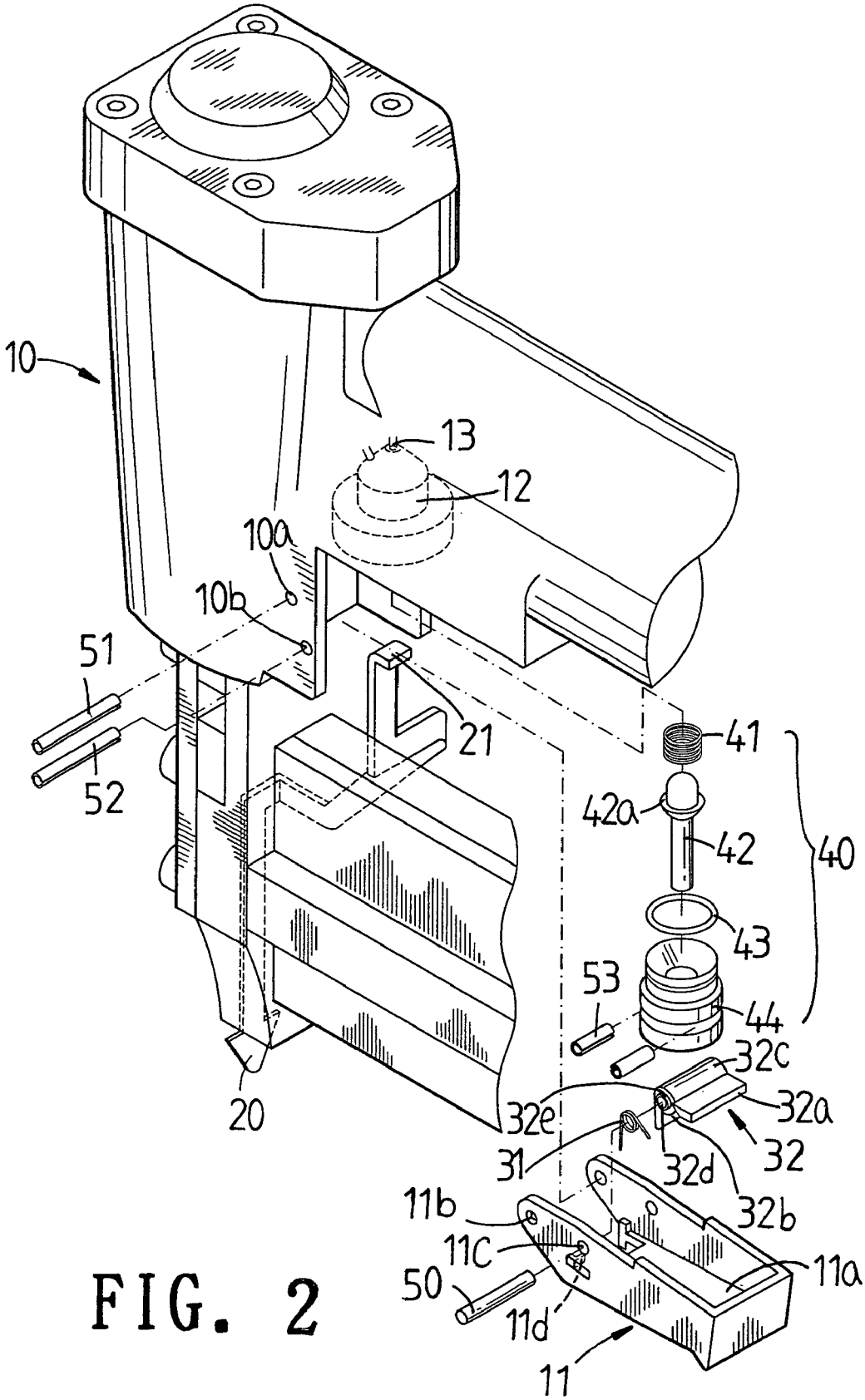
FIG. 2 is an exploded perspective view of the nailer as shown in FIG. 1.
Figure 3:
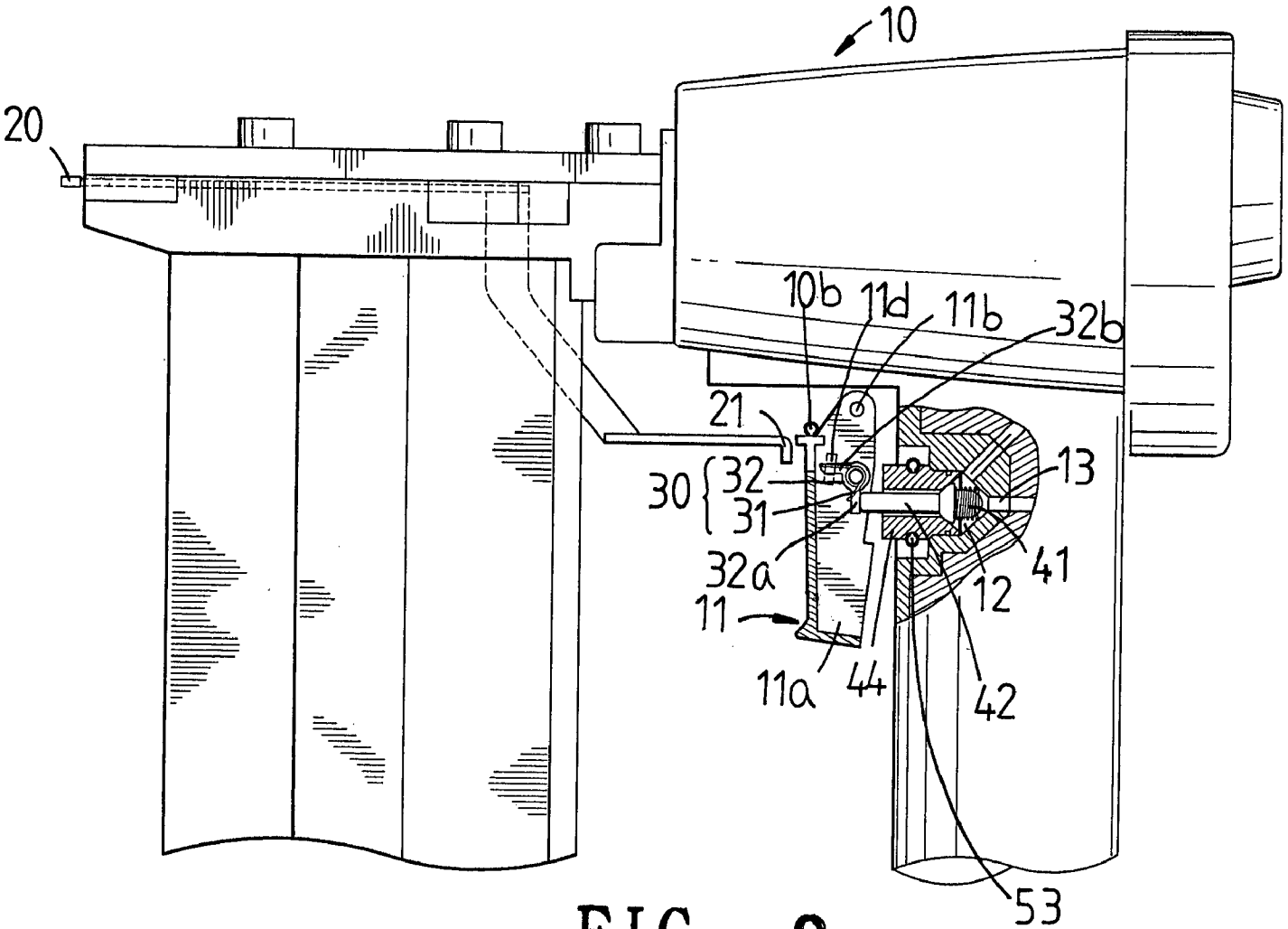
FIG. 3 is a partially plan cross-sectional view of the nailer as shown in FIG. 1.

Referring to the drawings and initially to FIGS. 1–3, a nailer in accordance with the preferred embodiment of the present invention comprises a gun body 10, a safety lever 20, a push device 30, and a contact trigger device 40.

The gun body 10 has an inside formed with a mounting chamber 12 and provided with a valve rod 13 mounted in the mounting chamber 12. The gun body 10 has two sides walls each formed with a pivot hole 10*a* and a positioning hole 10*b* located under the pivot hole 10*a*.

The contact trigger device 40 is mounted on the gun body 10 and includes a hollow mounting member 44 mounted in the mounting chamber 12 of the gun body 10 by two insertion pins 53 to prevent the mounting member 44 from detaching from the mounting chamber 12 of the gun body 10, an O-ring 43 mounted on an outer wall of the mounting member 44 and urged on a wall of the mounting chamber 12 of the gun body 10, an elongated contact member 42 slidably mounted in the mounting member 44 and having a first end that is movable to touch the valve rod 13 of the gun body 10 and a second end protruding outward from the mounting member 44, and an elastic member 41 urged between the wall of the mounting chamber 12 of the gun body 10 and the first end of the contact member 42. The first end of the elongated contact member 42 is formed with a protruding flange 42*a* located between the mounting member 44 and the mounting chamber 12 of the gun body 10.

A trigger 11 is pivotally mounted on the gun body 10 and has an inside formed with a receiving space 11*a*. The trigger 11 has two sides walls each formed with a pivot hole 11*b* and a mounting hole 11*c*. The trigger 11 is provided with a lug 11*d* located on one of the two side walls thereof. A pivot pin 51 is extended through the pivot holes 10*a* of the two side walls of the gun body 10 and the pivot holes 11*b* of the two side walls of the trigger 11, so that the trigger 11 is pivotally mounted on the gun body 10. A positioning pin 52 is extended through the positioning holes 10*b* of the two side walls of the gun body 10 and is rested on the trigger 11 to position the trigger 11 in place.

The push device 30 is pivotally mounted on the trigger 11 and is received in the receiving space 11*a* of the trigger 11. The push device 30 includes an urging member 32, and a torsion spring 31.

The urging member 32 includes a pivot portion 32*c* pivotally mounted on the trigger 11, a push portion 32*b* formed on a first side of the pivot portion 32*c*, and an urging portion 32*a* formed on a second side of the pivot portion 32*c* and rested on the second end of the contact member 42 of the contact trigger device 40. The push portion 32*b* of the urging member 32 has a width smaller than that of the urging portion 32*a* of the urging member 32. The pivot portion 32*c* of the urging member 32 is formed with a pivot hole 32*d*. A pivot shaft 50 is extended through the mounting holes 11*c* of the two side walls of the trigger 11 and the pivot hole 32*d* of the pivot portion 32*c*. The pivot portion 32*c* of the urging member 32 has a side formed with a protruding mounting seat 32*e*.

The torsion spring 31 is mounted on the mounting seat 32*e* of the pivot portion 32*c* and has a first end rested on the urging portion 32*a* of the urging member 32 and a second end rested on the lug 11*d* of the trigger 11. The torsion spring 31 has an elastic force smaller than that of the elastic member 41 of the contact trigger device 40.

The safety lever 20 is movably mounted on the gun body 10 and has a first end protruded outward from the gun body 10 and a second end formed with a catch portion 21 that is movable to touch the push portion 32*b* of the urging member 32.

Figure 4:
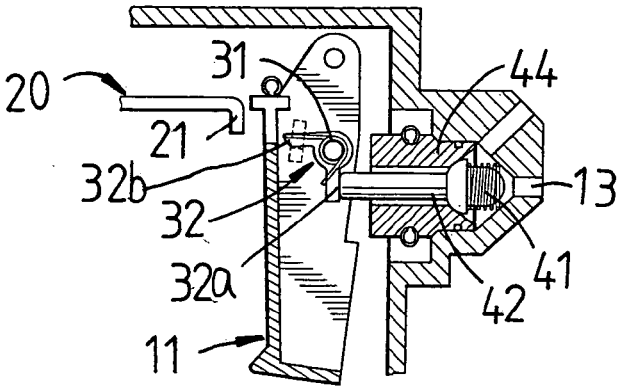
FIG. 4 is a partially enlarged view of the nailer as shown in FIG. 3.
Figure 5:
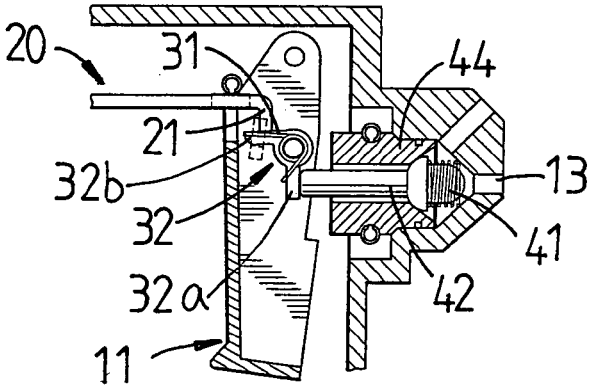
FIG. 5 is a schematic operational view of the nailer as shown in FIG. 4.
Figure 6:
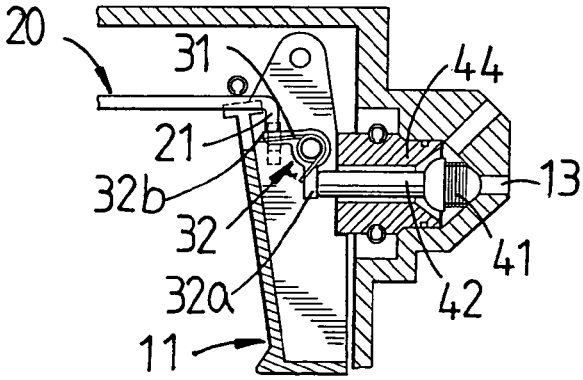
FIG. 6 is a schematic operational view of the nailer as shown in FIG. 5.
Figure 7:
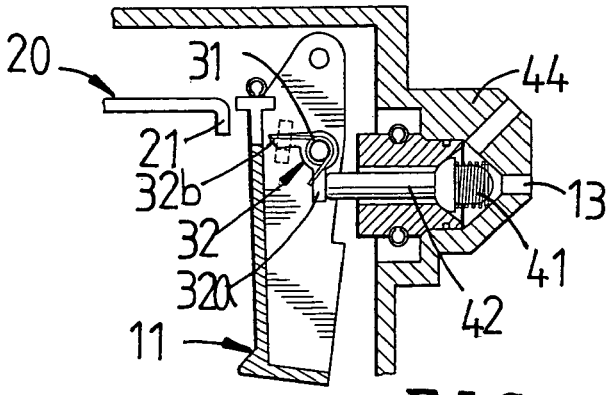
FIG. 7 is a partially enlarged view of the nailer as shown in FIG. 3.

Referring to 4–6 with reference to FIGS. 1–3, when the nailer is operated at the normal state, the first end of the safety lever 20 is pressed on a workpiece (not shown) so that the catch portion 21 of the safety lever 20 is moved from the position as shown in FIG. 4 to the position as shown in FIG. 5. At this time, the catch portion 21 of the safety lever 20 is moved into the trigger 11 and is rested on the push portion 32*b* of the urging member 32. Then, the trigger 11 is pressed toward the gun body 10 as shown in FIG. 6, to drive the urging member 32 to move toward the contact member 42 of the contact trigger device 40. At this time, the push portion 32*b* of the urging member 32 is urged by the catch portion 21 of the safety lever 20, so that the urging portion 32*a* of the urging member 32 is moved to press and move the second end of the contact member 42 of the contact trigger device 40, thereby moving the first end of the contact member 42 of the contact trigger device 40 to touch the valve rod 13 of the gun body 10 so as to trigger the ejection switch (not shown) mounted in the gun body 10.

Figure 8:
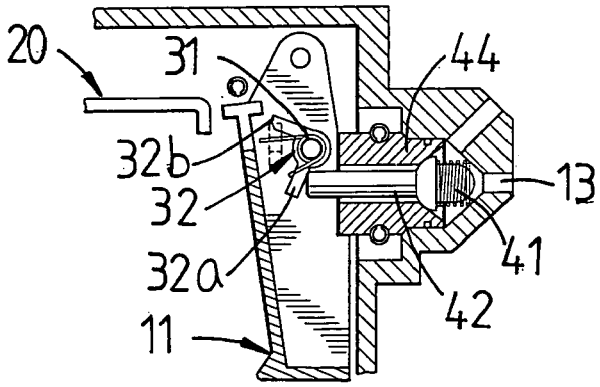
FIG. 8 is a schematic operational view of the nailer as shown in FIG. 7.

Referring to 7–9 with reference to FIGS. 1–3, when the nailer is not operated at the normal state, the trigger 11 is pressed toward the gun body 10 as shown in FIG. 8, to drive the urging member 32 to move toward the contact member 42 of the contact trigger device 40. At this time, the torsion spring 31 has an elastic force smaller than that of the elastic member 41 of the contact trigger device 40, so that the urging portion 32*a* of the urging member 32 cannot move the contact member 42 of the contact trigger device 40.

Figure 9:
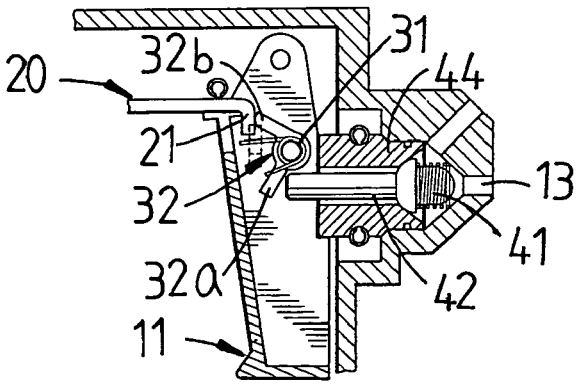
FIG. 9 is a schematic operational view of the nailer as shown in FIG. 8.

On the contrary, the urging portion 32*a* of the urging member 32 is pressed by the second end of the contact member 42 of the contact trigger device 40 to pivot the urging member 32, so that the pivot portion 32*c* of the urging member 32 is pivoted clockwise as shown in FIG. 9, and the push portion 32*b* of the urging member 32 is moved to align with the catch portion 21 of the safety lever 20. Thus, when the first end of the safety lever 20 is pressed, and the catch portion 21 of the safety lever 20 is moved toward the trigger 11, the catch portion 21 of the safety lever 20 is finally stopped by the push portion 32*b* of the urging member 32 as shown in FIG. 9, without possibility of triggering the ejection switch (not shown) mounted in the gun body 10.

Thus, the nailer is operated only when the first end of the safety lever 20 is initially pressed on a workpiece and the trigger 11 is then pressed, thereby providing a safety function to the user.

Accordingly, when the first end of the safety lever 20 is not pressed on a workpiece, the ejection switch of the nailer will not be operated, thereby providing a safety function to the user to prevent the user from operating the nailer due to touching the trigger 11 unintentionally, so as to protect the user's safety. In addition, the nailer has a simplified construction, thereby decreasing costs of fabrication and thereby facilitating the user mounting the nailer.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A nailer, comprising a gun body, a safety lever, a push device, and a contact trigger device, wherein:

the gun body is provided with a trigger having an inside formed with a receiving space for mounting the push device;

the push device is pivotally mounted on the trigger and includes an urging member, and a torsion spring;

the urging member is pivotally mounted on the trigger;

the torsion spring is mounted on the urging member and has a first end rested on an end of the urging member and a second end rested on the trigger, the torsion spring has an elastic force smaller than that of an elastic member mounted in the contact trigger device;

the safety lever is movably mounted on the gun body and has a first end protruded outward from the gun body and a second end formed with a catch portion that is movable to touch the urging member;

the first end of the safety lever is pressed on a workpiece, so that the catch portion of the safety lever is moved into the trigger to touch the urging member; and the trigger is pressed toward the gun body to drive the urging member to touch the contact trigger device, thereby triggering the contact trigger device.

2. The nailer in accordance with claim 1, wherein the trigger is provided with a lug located on one of the two side walls thereof, and the second end of the torsion spring is rested on the lug of the trigger.

3. The nailer in accordance with claim 1, wherein the gun body has an inside formed with a mounting chamber and provided with a valve rod mounted in the mounting chamber, the contact trigger device is mounted on the gun body and includes a hollow mounting member mounted in the mounting chamber of the gun body, an O-ring mounted on an outer wall of the mounting member and urged on a wall of the mounting chamber of the gun body, and an elongated contact member slidably mounted in the mounting member and having a first end that is movable to touch the valve rod of the gun body and a second end protruding outward from the mounting member to urge the urging member of the push device, and the elastic member is urged between the wall of the mounting chamber of the gun body and the first end of the contact member.

* * * * *